United States Patent [19]

Tamayo

[11] 4,314,254

[45] Feb. 2, 1982

[54] INSULATOR FOR FOLDABLE ELEMENTS OF DIPOLE TV ANTENNAS

[76] Inventor: Abel C. Tamayo, 7339 SW. 45th St., Miami, Fla. 33155

[21] Appl. No.: 157,042

[22] Filed: Jun. 6, 1980

[51] Int. Cl.[3] ..... H01Q 1/08

[52] U.S. Cl. ..... 343/809; 343/881

[58] Field of Search ..... 343/912, 915, 881, 882

[56] References Cited

U.S. PATENT DOCUMENTS 2,926,350 2/1960 Saul ..... 343/915

3,605,103 9/1971 Simons ..... 343/882

*Primary Examiner*—Eli Lieberman

*Attorney, Agent, or Firm*—Jesus Sanchelima

[57] ABSTRACT

A dipole element insulator integrally formed of a substantially rigid, yet somewhat resilient, synthetic plastic material has opposed dipole element rod supporting arms to which inner ends of the element rods are pivotally supported to enable their swinging towards and away from a supporting boom across which the insulator is fixed, outer marginal peripheral portions of which insulator arms are formed with U-shaped through slots defining outwardly-extending U-shaped marginal arm portions the outer or base sides of which are provided with ramps leading to central locking slots operative as detents for removably retaining the respective dipole element rods in their extended positions of use.

5 Claims, 8 Drawing Figures

INSULATOR FOR FOLDABLE ELEMENTS OF DIPOLE TV ANTENNAS

BACKGROUND OF THE INVENTION

This invention relates to dipole TV receiver antennas, and is directed particularly to insulators for insulating and supporting the element rods of such antennas with respect to one another and with respect to the booms along which the dipole elements of such antennas are arranged.

The use of one or more dipole elements, each of which comprises a central insulator and a pair of opposed element rods spaced along a horizontally-extending support boom, is well known in TV receiver antenna construction. Various multiple arrangements of such dipoles secured along a common support boom to achieve the desired electrical characteristic ratios of bandwidth to signal gain are also known. Such TV assemblages or "arrays", because of their size, utilize dipole constructions the element rod of which, for storage and transportation purposes, can be pivoted or "folded" inwardly against the common supporting boom. Upon installation of the dipole TV antenna, the dipole element rods are "unfolded", or swung outwardly about their insulator pivot points, to their extended positions of use. To enable such pivotal swinging of dipole element rods with respect to their common, central insulator, resilient metal clips of one kind or another, fixed either with respect to the pivotal inner end of a dipole element rod, or with respect to an outer end portion of the insulator, serve to cooperatively snap-fit as a detent when the pertaining dipole element rod is moved to its predetermined, extended position of use. Such a dipole element and insulator is exemplified in U.S. Pat. No. 3,605,103 to Simons, wherein separate resilient clips secured at the inner ends of the dipole element rods ar formed with tail-pieces adapted to snap into slots formed in the dipole element supporting insulator when the element rods are turned about their pivot points to their outstretched positions of use. Such previously known dipole element insulators are deficient in various respects, principally in their use of extra positional locking clips or the like in the detent or snap-fit mechanism for removably retaining their associated dipole element rods in the extended position of use. Such extra parts, usually formed of sheet metal, not only are apt to undesirably add to the distributive parasitic capacitance of the individual dipoles and the dipole array constituting the TV antenna, but are also subject to metal fatigue caused by wind induced stresses, with the likelihood of premature mechanical breakdown.

It is, accordingly, the principal object of this invention to provide a novel and improved insulator for the foldable elements of dipole TV antennas that obviates the deficiencies of such insulators heretofore known.

A more particular object of the invention is to provide a dipole element insulator of the above nature, the dipole element rod detent mechanism of which is integrally incorporated in the monolithic design of the insulator itself, and is therefore devoid of extra parts such as spring clips and the like, whereby any deficiencies such as early metal fatigue breakdown and added distributive capacitance associated therewith, are obviated.

Another object is to provide a dipole element insulator of the character described which is integrally formed, such as by injection molding, of a substantially rigid, but somewhat resilient, synthetic plastic material such as polypropolene, the opposed dipole element rod supporting arms of which are provided with a marginal U-shaped, outwardly-extending portion resiliently removable with respect to the main body of the insulator and having, along its outer margin, a ramp and locking slot operative as a detent in retaining an associated pivotally supported dipole element rod in an extended position of use.

Yet another object is to provide an improved dipole element insulator of the above nature which will be comparatively inexpensive to manufacture, uniquely functional in operation, environmentally resistant, and durable in use.

Other objects, features and advantages of the invention will be apparent from the following description when read with reference to the accompanying drawings. In the drawings, wherein like reference numerals denote corresponding parts throughout the several views.

Figure 1:
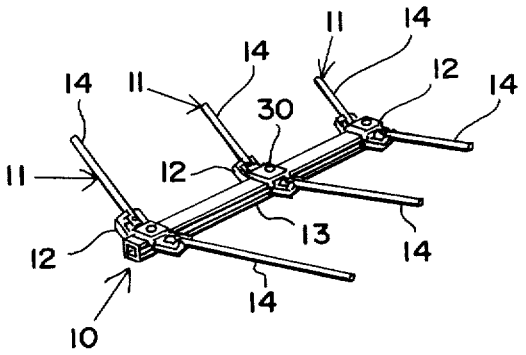
FIG. 1 illustrates an oblique view from above of a multiple element TV antenna embodying the invention, illustrating use of one form of foldable dipole insulator embodying the invention.
Figure 2:
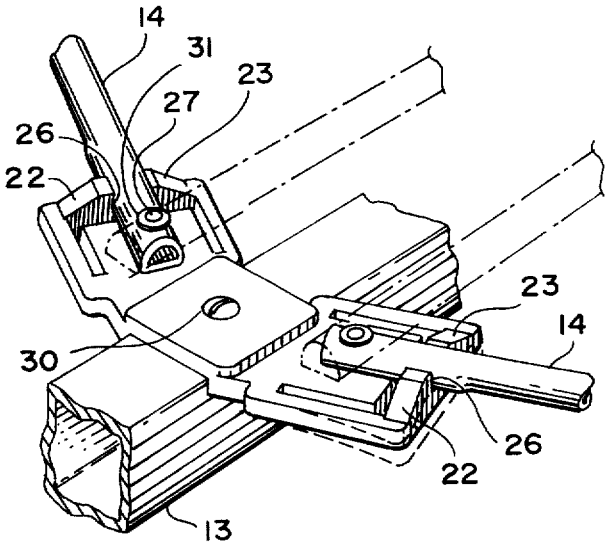
FIG. 2 is a fragmentary enlarged view of one of the dipole insulators shown in FIG. 1, on an enlarged scale to illustrate constructional and operational details.

Referring now in detail to the drawings, reference numeral 10 in FIG. 1 illustrates a typical multiple element TV antenna, three elements being illustrated by way of example, each of which comprises a dipole 11 comprising an insulator 12 embodying the invention. As illustrated in FIGS. 1 and 2, the insulators 12 are fixed in appropriately spaced relation along a horizontal boom 13 for efficient high gain, broad band reception. Since the present invention is directed specifically to an improved insulator for such dipole antenna arrays, no further description of their use in multiple dipole element antenna arrays is deemed to be necessary. It is only to be emphasized that insulators embodying the invention as herein illustrated, described and claimed, provide for folding of the dipole element rods 14 inwardly against their supporting boom 13 for compact storing and shipment of an assembled antenna array such as is illustrated in FIG. 1.

Figure 3:
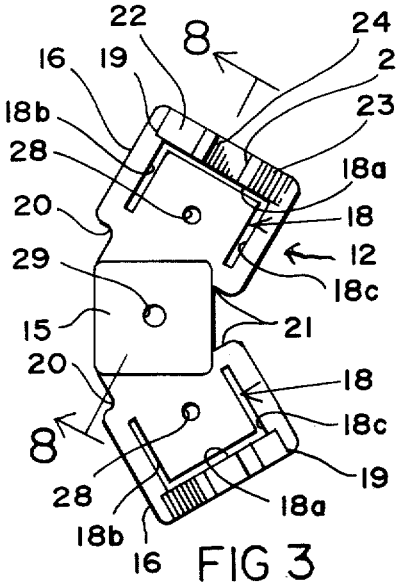
FIG. 3 is an outside plan view of the dipole insulator illustrated in FIG. 2, shown separately and without the dipole element rods.
Figure 4:
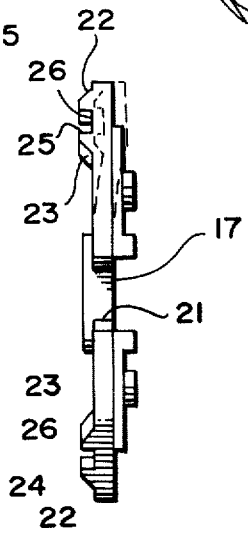
FIG. 4 is a projected edge view of the dipole insulator as illustrated in FIG. 3.
Figure 8:
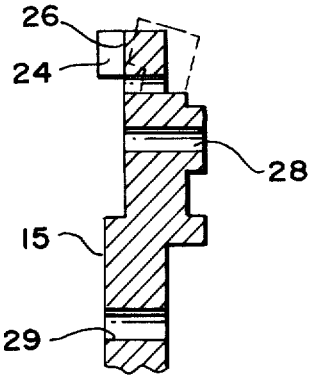
FIG. 8 is a fragmentary cross-sectional view taken along the line 8—8 of FIG. 3 or FIG. 5 in the direction of the arrows.

Referring now in detail to FIGS. 2, 3 and 4 of the drawings, insulator 12 is integrally molded of a synthetic plastic material such as polypropolene, and has a slightly raised, square, central portion 15, the outwardly-opposed ends of which extend into substantially rectangular arm portions 16, said arm portions being symmetrical with respect to said central portion and being inclined in a common plane to define an obtuse angle. The underside of the central square portion 15 is formed with a rectangular slot 17, the central axis of which defines the axis of symmetry of the rectangular arm members 16. As is hereinafter more particularly described, the rectangular slot 17 is provided for the seating reception of an outer surface portion of a boom 13 in the assembly of a TV dipole antenna array such as illustrated in FIG. 1. As best illustrated in FIG. 3, each of the arm portions 16 of the integrally formed insulator 12 is formed with a U-shaped through slot 18, the base portion 18*a* of which is in spaced, parallel relation with respect to the outer end of its pertaining arm portion 16, and the leg portions 18*b* and 18*c* of which are in spaced, parallel relation with respect to the opposed sides of said arm portion. The U-shaped slots 18 thus define U-shaped outer marginal portions 19 of rectangular arm portions 16, which join with central square portion 15 at junctures 20 and 21. As illustrated in FIGS. 2, 3 and 4, the outer ends of the marginal outer portions 19 are integrally formed at each side with opposed, angularly outwardly-extending ramp portions 22, 23 terminating at opposed, vertical sidewalls 24, 25, defining therebetween a central, longitudinally-extending channel 26 the bottom surface of which is substantially flush with the outside surface of the remainder of its associated rectangular arm member 16. It is to be understood that, for purposes hereinafter described, the material of which the insulator 12 is integrally molded, while being substantially rigid, at the same time possesses a degree of resilience sufficient to permit flexing of the U-shaped outer marginal portions with respect to the remainder of the rectangular arm portions 16 at their junctures 20, 21.

As illustrated in FIGS. 1 and 2, the dipole element rods 14, when in the assembled position of use, extend at their inner ends through respective insulator channels 26, to be pivotally secured against the outsides of arm portions 16 with the use of rivets 27 extending through openings 28 in the insulator, and through a diametrical opening provided in its tubular dipole element rod 14, a washer 31 preferably being fitted under the peaned-over end of the rivet. Electrical connection to the dipole element rods (not illustrated herein) normally will also be made at these zones of pivotal juncture.

A salient feature of the above-described integrally formed insulator resides in the resilience of the dipole element rod retaining U-shaped portions 19 whereby, as illustrated by the broken-line representation thereof in FIG. 2, they can be bent downwardly to free their respective element rods 14 from associated channels 26, and thereby permit folding thereof compactly along the length of the associated dipole array boom 13 for compact storage, packaging and shipment, (see broken-line positional representation of the element rods 14 in FIG. 2). To "set up" the thus folded antenna array for use, is only necessary to push the element rods 14 outwardly of the supporting boom about their pivotally supporting rivets 27, whereupon they will ride over ramp portions 23 to depress associated U-shaped outer marginal portions 19 of rectangular arm portions 16 which, because of their above described resiliency, will flex downwardly, (as illustrated by the broken-line representation thereof in FIG. 2) until said rods are in alignment with their respective channels, at which time they will return automatically to positionally lock the element rods in place.

Figure 5:
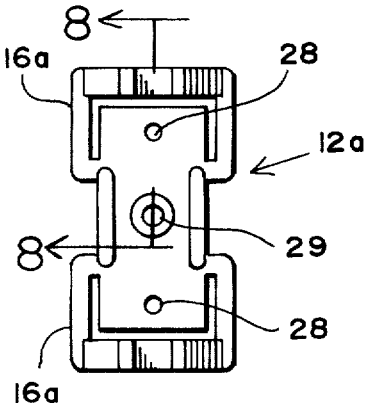
FIG. 5 is an outside plan view of a modified form of the dipole insulator embodying the invention.
Figure 6:
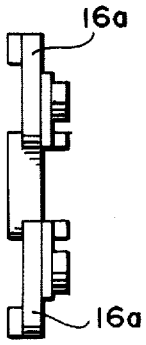
FIG. 6 is a projected edge view of the dipole insulator as illustrated in FIG. 5.
Figure 7:
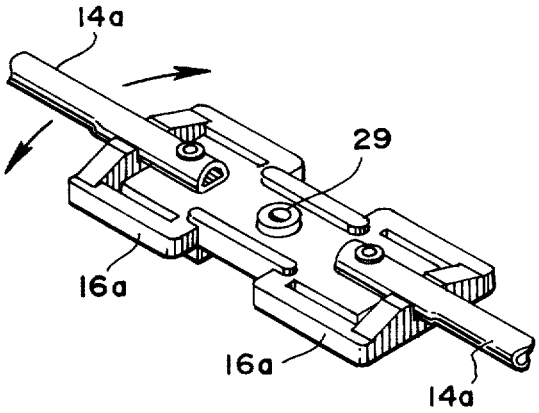
FIG. 7 is an oblique view, as seen from above, of the outside of the dipole insulator illustrated in FIGS. 5 and 6, on an enlarged scale and with portions of its associated element rods.

The modified form of insulator 12*a* illustrated in FIGS. 5, 6 and 7 differs from the above-described embodiment of FIGS. 1 through 4 and 8, only that instead of the substantially rectangular arm portions 16*a* being at an obtuse angle with each other, they are oppositely directed along a common axis. Thus, instead of dipole element rods 14*a* assembled thereto (see FIG. 7) being directed at an obtuse angle (see FIG. 2) they are constrained at their locked-in-place positions to opposed positions along a common axis, i.e., 180 circular degrees removed from each other. It will be understood that the choice of insulator and resultant relative angular disposition of the dipole element rods is contingent upon the electrical characteristics designed in the antenna array, particularly with respect to relative gain and bandwidth desiderata. Constructional and operational details of the modified form of the insulator illustrated in FIGS. 5, 6 7 and 8 are otherwise the same as that of the first embodiment of the invention illustrated in FIGS. 1 through 4 and described above. Each insulator, moreover, is provided with a central through opening 29 for the reception of a bolt 30 for supporting the insulator assembly along a supporting boom 13.

While there are illustrated and described herein only two forms in which the invention can conveniently be embodied in practice, it is to be understood that these forms are presented by way of example only, and not in a limiting sense. The invention, in brief, comprises all the embodiments and modifications coming within the scope and the spirit of the following claims.

What is claimed as new and for which it is desired to secure Letters Patent is:

1. A dipole element insulator comprising, in combination, a body member integrally molded of a substantially rigid, yet somewhat resilient, synthetic plastic material, said body member having a central portion and opposed, symmetrically-arranged, outwardly-extending arm portions, means for supporting said central portion of said body member to a TV antenna support boom in transverse relation with respect thereto so that said opposed arm portions extend laterally outwardly of the boom in opposite directions, means for pivotally and swingingly supporting inner end portions of a pair of tubular dipole element rods, one each, against said opposed side arm portions of said insulator body member, whereby, when said insulator is so supported with respect to a supporting boom, said element rods can be pivotally swung between a first position whereat they lie close along the boom, and a second position whereat they will be in opposed, outstretched relation with respect to the boom, and detent means integrally formed along outer marginal portions of said insulator body arm portions for removably locking the dipole element rods in said second position wherein said integrally formed detent means comprises a U-shaped through slot in each of said insulator body arm portions, said U-shaped slots defining respective U-shaped, outwardly extending, marginal detent portions the outer ends of the opposed legs of which connect with said central portion of said insulator body member, the outer ends of said U-shaped marginal detent portions being formed with laterally opposed ramp portions defining therebetween a central locking slot for the removable reception, one each, of said dipole element rods.

2. A dipole element insulator as defined in claim 1, wherein said outwardly extending arm portions define therebetween an obtuse angle of less than 180 circular degrees.

3. A dipole element insulator as defined in claim 1, wherein said body member arm portions are directly opposite each other to define therebetween an angle of 180 circular degrees.

4. A dipole element insulator as defined in claim 1, wherein said means for supporting said central portion of said body member to a TV antenna support boom comprises a transversely extending, rectangular slot in said central portion of said body member for the reception of an outer peripheral surface portion of a support boom.

5. A dipole element insulator as defined in claim 1, wherein said means for pivotally and swingingly supporting inner end portions of a pair of tubular dipole element rods comprises a through opening centrally located in each of said outwardly extending arm portions, a pair of tubular dipole element rods, and a pair of rivets extending one each through said through openings of said arm portions and through diametrically extending through openings, one each, at inner end portions of said dipole element rods.

* * * * *